US009958806B2

(12) United States Patent
Tsuji et al.

(10) Patent No.: US 9,958,806 B2
(45) Date of Patent: May 1, 2018

(54) DEVELOPING DEVICE AND IMAGE FORMING APPARATUS INCORPORATING SAME

(71) Applicants: Masato Tsuji, Kanagawa (JP); Tetsumaru Fujita, Kanagawa (JP); Yuji Nagatomo, Kanagawa (JP); Mitsutoshi Kichise, Osaka (JP); Yutaro Kaku, Tokyo (JP); Kazuki Matsumoto, Kanagawa (JP)

(72) Inventors: Masato Tsuji, Kanagawa (JP); Tetsumaru Fujita, Kanagawa (JP); Yuji Nagatomo, Kanagawa (JP); Mitsutoshi Kichise, Osaka (JP); Yutaro Kaku, Tokyo (JP); Kazuki Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/346,018

(22) Filed: Nov. 8, 2016

(65) Prior Publication Data

US 2017/0146925 A1 May 25, 2017

(30) Foreign Application Priority Data

Nov. 25, 2015 (JP) ..... 2015-229595
Oct. 17, 2016 (JP) ..... 2016-203388

(51) Int. Cl.
*G03G 15/08* (2006.01)

(52) U.S. Cl.
CPC ..... *G03G 15/0812* (2013.01)

(58) Field of Classification Search
CPC ..... G03G 15/0812; G03G 15/081
See application file for complete search history.

(56) References Cited

U.S. PATENT DOCUMENTS

2009/0041511 A1* 2/2009 Fuwa ..... G03G 9/097 399/284
2012/0045255 A1* 2/2012 Hamada ..... G03G 15/0812 399/284
2012/0230708 A1 9/2012 Fujita et al.
2012/0237268 A1 9/2012 Sakashita et al.
2013/0051854 A1 2/2013 Sakuma et al.
2013/0259532 A1 10/2013 Kubota et al.
2013/0266347 A1 10/2013 Kubota et al.
2014/0029962 A1 1/2014 Shimizu et al.
2014/0050507 A1 2/2014 Hamada et al.
(Continued)

FOREIGN PATENT DOCUMENTS

JP 2001-249538 9/2001
JP 2005-099495 4/2005
JP 2009-282461 12/2009

*Primary Examiner* — Hoang Ngo
(74) *Attorney, Agent, or Firm* — Oblon, McClelland, Maier & Neustadt, L.L.P.

(57) ABSTRACT

A developing device includes a toner bearer to rotate while bearing toner and a toner regulator including a bend on a free end side. The bend is disposed in contact with a surface of the toner bearer and defines a regulation nip to adjust an amount of the toner on the toner bearer. The toner regulator further includes an area having a water contact angle greater than or equal to 70 degrees. The area having the water contact angle includes, at least, a downstream end of the bend in a rotation direction of the toner bearer.

8 Claims, 3 Drawing Sheets

(56) References Cited

U.S. PATENT DOCUMENTS

| | | | |
|---|---|---|---|
| 2014/0153972 | A1 | 6/2014 | Tsuritani et al. |
| 2014/0294449 | A1 | 10/2014 | Kubota et al. |
| 2016/0004208 | A1 | 1/2016 | Kubota et al. |
| 2016/0139540 | A1 | 5/2016 | Kubota et al. |

* cited by examiner

DEVELOPING DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2015-229595, filed on Nov. 25, 2015, and 2016-203388, filed on Oct. 17, 2016, in the Japan Patent Office, the entire disclosure of which is hereby incorporated by reference herein.

BACKGROUND

Technical Field

Embodiments of the present invention generally relate to a developing device and an image forming apparatus, such as a copier, a printer, a facsimile machine, or a multifunction peripheral having at least two of copying, printing, facsimile transmission, plotting, and scanning capabilities, that includes the developing device.

Description of the Related Art

There are developing devices that include a regulator (e.g., a regulation blade) pressed against a surface of a toner bearer (e.g., a developing roller). The regulator adjusts the amount of toner borne on the toner bearer while giving electrical charges to the toner through triboelectric charging.

SUMMARY

An embodiment of the present invention provides a developing device that includes a toner bearer to rotate while bearing toner and a toner regulator including a bend on a free end side of the toner regulator. The bend is disposed in contact with a surface of the toner bearer and defines a regulation nip to adjust an amount of the toner on the toner bearer. The toner regulator further includes an area having a water contact angle greater than or equal to 70 degrees. The area having the water contact angle includes, at least, a downstream end of the bend in a rotation direction of the toner bearer.

In another embodiment, an image forming apparatus includes an image bearer and the above-described developing device to develop a latent image on the image bearer with the toner.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
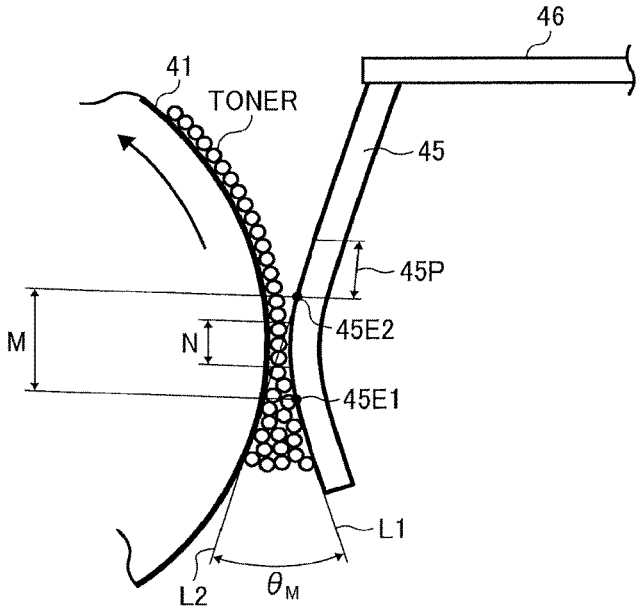
FIG. 1 is a schematic view illustrating a regulation nip of a developing device according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 2, an electrophotographic printer is described below as an image forming apparatus according to an embodiment.

It is to be noted that the suffixes Y, M, C, and Bk attached to each reference numeral indicate only that components indicated thereby are used for forming yellow, magenta, cyan, and black images, respectively, and hereinafter may be omitted when color discrimination is not necessary.

A basic configuration of the image forming apparatus is described below with reference to FIG. 2, which is a schematic diagram illustrating an image forming apparatus 100 according to the present embodiment.

Figure 2:
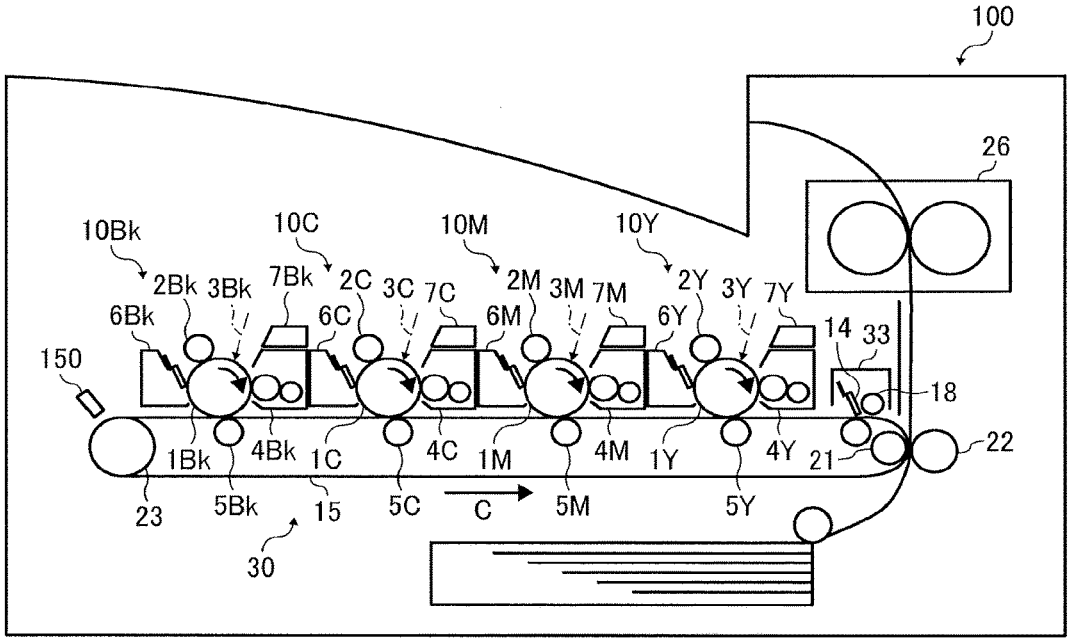
FIG. 2 is a schematic diagram of an image forming apparatus according to an embodiment.

The image forming apparatus 100 illustrated in FIG. 2 includes four process cartridges 10 (10Y, 10M, 10C, and 10Bk) for forming yellow (Y), magenta (M), cyan (C), and black (Bk) toner images, respectively. The process cartridges 10 have a similar configuration except that the color of toner used therein is different and are replaced when their operational lives expire. As illustrated in FIG. 2, each of the process cartridges 10 includes a drum-shaped photoconductor 1 (1Y, 1M, 1C, or 1Bk) serving as a latent image bearer, a charging device 2 (2Y, 2M, 2C, or 2Bk), a developing device 4 (4Y, 4M, 4C, or 4Bk), and a drum cleaning device 6 (6Y, 6M, 6C, or 6Bk) to remove toner remaining on the photoconductor 1 after a toner image is transferred therefrom. Above the developing device 4, a toner container 7 (7Y, 7M, 7C, or 7Bk) is disposed. Inside the developing device 4, a casing 40 serves as a toner containing compartment.

The process cartridges 10 are described in further detail using the process cartridge 10Bk to form black toner images. The process cartridge 10Bk is removably mountable in a body of the image forming apparatus 100, and thus consumables can be replaced at a time.

Figure 3:
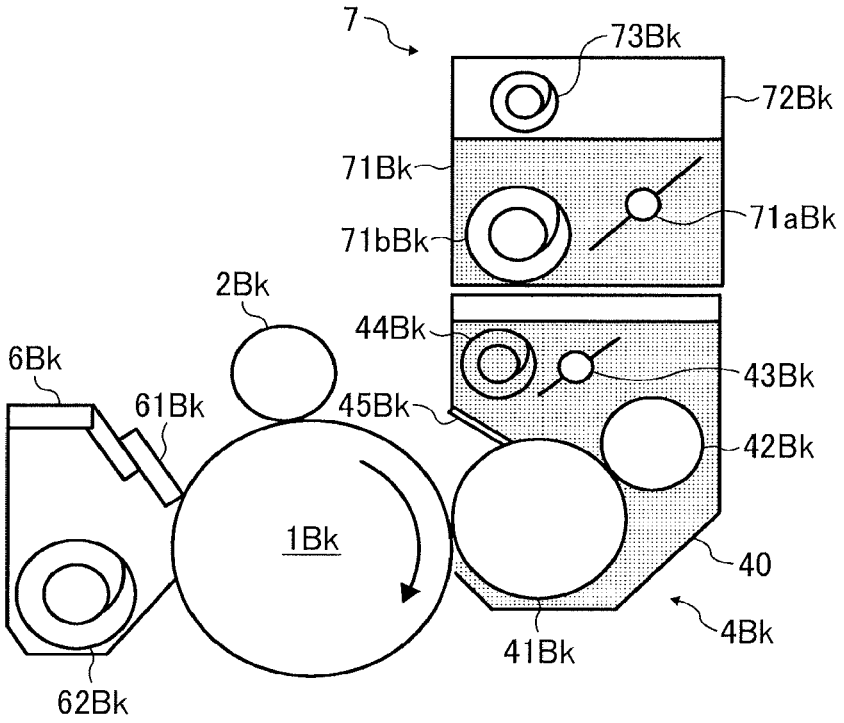
FIG. 3 is a schematic view of a process cartridge for black and peripheral components according to an embodiment.

The developing device 4Bk is a one-component developing device to develop latent images with one-component developer including magnetic toner. Referring to FIG. 3, the developing device 4Bk includes a developing roller 41Bk serving as a toner bearer and a toner supply roller 42Bk serving as a toner supplier. The toner container 7Bk includes a toner reservoir 71Bk to store fresh toner and a waste toner container 72Bk disposed above the toner reservoir 71Bk. The waste toner container 72Bk stores waste toner. Further, an agitator 71*a*Bk is disposed in the toner reservoir 71Bk. The agitator 71*a*Bk is rotated by a driver. The toner reservoir 71Bk further includes a toner conveyor 71*b*Bk to transport the toner to a supply opening, at which the toner reservoir 71Bk is coupled to the developing device 4Bk. For example, the toner conveyor 71*b*Bk is a screw or a coil. The toner conveyor 71*b*Bk is rotated by the driver. Preferably, the agitator 71*a*Bk is rotated constantly to stir the fresh toner inside the toner reservoir 71Bk to maintain the flowability of the toner.

The developing device 4Bk includes a toner conveyor 44Bk such as a screw. The toner conveyor 44Bk distributes the toner supplied from the toner reservoir 71Bk in the axial direction of the developing roller 41Bk (i.e., a longitudinal direction of the developing device 4Bk). The developing device 4Bk further includes the developing roller 41Bk, an agitator 43Bk to stir the toner inside the developing device 4Bk, and a regulation blade 45Bk, and the toner supply roller 42Bk. The regulation blade 45Bk is disposed in contact with the surface of the developing roller 41Bk so that the regulation blade 45Bk levels the toner on the developing roller 41Bk into a thin layer.

The toner supply roller 42Bk is disposed in contact with the developing roller 41Bk and supplies toner adhering thereto to the developing roller 41Bk while rotating in the direction either following or counter to the rotation of the developing roller 41Bk. The toner supply roller 42Bk is covered with a foamed material having pores or cells at the surface thereof. The toner supply roller 42Bk efficiently absorbs the toner inside the developing device 4Bk while alleviating deterioration of the toner due to localization of pressure in a contact portion with the developing roller 41Bk. In the description below, reference "Bk" representing black color is omitted for simplicity.

For example, the developing roller 41 includes a metal shaft; an elastic layer made of urethane rubber, silicone rubber, nitrile butadiene rubber (NBR), or the like; and a resin coat layer made of acrylic resin, urethane resin, or the like. The resin coal layer preferably has a thickness of from 1 μm to 30 μm. Instead of providing the resin coat layer, the developing roller 41 can be subjected to surface treatment such as ultraviolet (UV) irradiation. For example, the toner supply roller 42 includes a metal shaft and a formed material overlying the metal shaft. Example formed materials include foamed urethane, formed silicone, and foamed ethylene-propylene-diene monomer (EPDM). The formed material is preferably subjected to conductive treatment. The toner supply roller 42 is rotated while being kept in contact with the developing roller 41. The toner supply roller 42 scrapes off the toner remaining on the developing roller 41 while supplying the toner thereto.

To the toner supply roller 42, a power supply (i.e., a voltage application device) applies a voltage identical in polarity to a normal charge polarity (negative) of toner and lower than a negative voltage applied to the developing roller 41. That is, the voltage applied to the toner supply roller 42 is a negative voltage greater in absolute voltage than the voltage applied to the developing roller 41.

Thus, an electrical field is generated in the contact portion with the developing roller 41. In the developing device 4, the agitator 43 promotes triboelectric charging while stirring the toner, and the toner is charged in the negative polarity, which is the normal charge polarity. Accordingly, the toner borne on the toner supply roller 42 and transported to the contact portion with the developing roller 41 moves toward the developing roller 41 due to an effect of the electrical field. Then, the toner electrostatically adheres to the developing roller 41. As the developing roller 41 rotates, the toner adhering thereto passes the position where the regulation blade 45 contacts the developing roller 41, and the layer thickness of the toner on the developing roller 41 is adjusted. Subsequently, in a developing range where the developing roller 41 contacts (or is closest to) the photoconductor 1, the toner adheres to an electrostatic latent image on the surface of the photoconductor 1. Thus, the electrostatic latent image is developed into a toner image.

The drum cleaning device 6 (6Bk in FIG. 3) includes a cleaning blade 61 (61Bk in FIG. 3) and a waste toner conveyor 62 (62Bk in FIG. 3). The cleaning blade 61 is an elastic body abutting against the photoconductor 1 (i.e., an edge of the cleaning blade 61 is in contact with the photoconductor 1). The waste toner conveyor 62 transports the waste toner (i.e., residual toner) removed by the cleaning blade 61. Further, a waste toner screw 73 (73Bk in FIG. 3) transports the waster toner through a toner collecting passage to the waster toner container 72. The waste toner collected in the waster toner container 72 is not reused in image developing but is kept in the waster toner container 72. The toner container 7 is removably mounted in the apparatus body. When the toner container 7 becomes empty, the toner container 7 is removed from the apparatus body and replaced with another toner container 7 containing fresh toner. At that time, the waste toner stored in the waster toner container 72 is collected simultaneously.

The image forming apparatus 100 includes a detector to detect the amount of toner in the developing device 4. When the amount of the developer contained in the developing device 4 falls below a predetermined amount, a controller of the image forming apparatus 100 drives the toner conveyor 71*b* to supply the toner from the toner reservoir 71 to the developing device 4. That is, the controller and the toner conveyor 71*b* together function as a toner supply device. The flowability of toner changes depending on the temperature and the humidity in the apparatus. Accordingly, if the toner conveyor 71*b* is regularly driven for a constant period, the amount of fresh toner supplied to the developing device 4 fluctuates depending on the environment in or around the apparatus. Therefore, in an embodiment, the apparatus includes a temperature and humidity sensor, and the controller changes the driving time of the toner conveyor 71*b* based on detection results generated by the temperature and humidity sensor.

Although FIG. 3 illustrates the process cartridge 10Bk for black, the process cartridges 10Y, 10M, and 10C are similar in configuration to the process cartridge 10Bk. Through similar processes, yellow, magenta, and cyan toner images are formed on the surfaces of the photoconductors 1Y, 1M, and 1C.

Referring back to FIG. 2, below the process cartridges 10Y, 10M, 10C, and 10Bk, a transfer unit 30 is disposed. The transfer unit 30 includes an intermediate transfer belt 15 which moves endlessly. The intermediate transfer belt 15 is entrained around a tension roller 23 and a secondary-transfer backup roller 21 and rotated in the direction indicated by arrow C, by a driving motor attached to an end of the secondary-transfer backup roller 21. In addition to the intermediate transfer belt 15 the transfer unit 30 includes four primary transfer rollers 5 (5Y, 5M, 5C, and 5Bk) and a belt cleaner 33. The transfer unit 30 is removably mounted in the body of the image forming apparatus 100 so that multiple consumables are replaceable at a time.

Descriptions are given below of image formation in negative-positive developing in the above-described structure.

In negative-positive developing, an exposed area potential is lower in absolute value than an unexposed area potential to cause toner to adhere to the exposed area. The charging devices 2Y, 2M, 2C, and 2Bk charge uniformly the photoconductors 1Y, 1M, 1C, and 1Bk in the negative polarity, respectively. Subsequently, an exposure device, which is disposed above the photoconductors 1Y, 1M, 1C, and 1Bk and serves as a latent image forming device, emits beams 3Y, 3M, 3C, and 3Bk of writing light to the photoconductors 1Y, 1M, 1C, and 1Bk according to image data. Thus, electrostatic latent images are formed on the photoconductors 1Y, 1M, 1C, and 1Bk, respectively. The beam 3 can be a laser beam, a light-emitting diode (LED) beam, or the like. Then, the power supply applies a developing bias, which is larger in absolute value than the unexposed area potential on the photoconductor 1, to the developing roller 41 of each of the developing devices 4Y, 4M, 4C, and 4Bk. The toner on the developing roller 41 is caused to adhere to the electrostatic latent image on the photoconductor 1. Thus, a toner image corresponding to the electrostatic latent image is formed on each of the photoconductors 1Y, 1M, 1C, and 1Bk.

Then, the toner images are primarily transferred from the photoconductors 1Y, 1M, 1C, and 1Bk onto the intermediate transfer belt 15 and superimposed one on another thereon. The superimposed toner images form a multicolor toner image. The cleaning blade 61 of the drum cleaning device 6 removes residual toner from the photoconductor 1.

The image forming apparatus 100 further includes a sheet tray containing transfer sheets (recording media) below the intermediate transfer belt 15. The transfer sheet fed from the sheet tray is guided by a sheet feeding guide and transported by conveyance roller pairs to a registration roller pair (i.e., a temporary stop position). The registration roller pair forwards the transfer sheet at a predetermined timing to a secondary transfer position between a portion of the intermediate transfer belt 15 wound around the secondary-transfer backup roller 21 and a secondary transfer roller 22. Then, a power supply applies a secondary transfer bias to the secondary transfer roller 22 to secondarily transfer the multicolor toner image from the intermediate transfer belt 15 onto the transfer sheet. Then, a fixing device 26 fixes the multicolor toner image on the transfer sheet, after which the transfer sheet is ejected onto an output tray. Additionally, the belt cleaner 33 removes the residual toner on the intermediate transfer belt 15 after the toner image is transferred therefrom. The belt cleaner 33 includes a cleaning blade 14 disposed in contact with (abuts against) the outer face of the intermediate transfer belt 15. The posture of the cleaning blade 14 is counter to the direction of movement of the intermediate transfer belt 15. Further, a cleaning backup roller made of metal is disposed opposite the cleaning blade 14 via the intermediate transfer belt 15. The toner removed by the cleaning blade 14 of the belt cleaner 33 is transported by a conveying coil 18 and the like to the waster toner container 72 inside the toner container 7.

Additionally, as illustrated in FIG. 2, a toner sensor 150 is disposed downstream from the process cartridge 10Bk in the direction in which the intermediate transfer belt 15 moves to detect the toner on the intermediate transfer belt 15. The toner sensor 150 detects the toner adhesion amount on the intermediate transfer belt 15 and positions of the toner images of respective colors on the intermediate transfer belt 15 for image density adjustment and alignment. As a detection type of the toner sensor 150, specular reflection and diffuse reflection are combined.

FIG. 1 is a schematic view illustrating a regulation nip N of the developing device 4.

The regulation blade 45 is a thin metal plate, and an end of the regulation blade 45 is secured to a holder 46 for reinforcement. In one embodiment, the thin metal plate is a stainless steel plate of 0.1 mm in thickness. The thickness is from about 0.04 mm to about 0.2 mm, for example. Metal thin plates made of stainless steel or the like are produced by rolling and have surface unevenness (projections and recesses) due to the rolling. The regulation blade 45 is bent at a predetermined distance from a free end (opposite the end supported by the holder 46) thereof to form a bend M, which projects toward the developing roller 41 as illustrated in FIG. 1. In an example, the bend M is disposed at 0.5 mm from the free end. A bend angle $\theta_M$ of the bend M is preferably in a range of from 10 to 90 degrees and, more preferably, from 10 to 40 degrees.

The bend angle $\theta_M$ is defined as an angle formed by a first line L1 and a second line L2 illustrated in FIG. 1. On the cross section illustrated in FIG. 1, reference numerals 45E1 and 45E2 respectively represent an upstream end and a downstream end of the bend M in the rotation direction of the developing roller 41 (e.g., the toner bearer), the first line L1 represents an upstream face of the regulation blade 45 upstream from the upstream end 45E1, and the second line L2 represents a downstream face of the regulation blade 45 downstream from the downstream end 45E2 in the rotation direction of the developing roller 41.

Additionally, the regulation blade 45 includes an area 45P (e.g., a smooth surface portion) having a predetermined water contact angle, which is greater than or equal to 70 degrees. In the present embodiment, in the rotation direction of the developing roller 41, the area 45P extends downstream for a length not smaller than 0 mm and not greater than 3 mm from the downstream end 45E2. In other words, the area 45P includes, at least, the downstream end 45E2 of the bend M. In one example, the area 45P extends for 5 mm from the free end of the regulation blade 45 in the rotation direction.

In one example, the area 45P is produced by polishing with wrapping film. After bending processing, the surface of the regulation blade 45 is polished with wrapping film or the like to make the surface smooth. An example of the wrapping film is made by applying a polishing agent to a base such as polyester or polyethylene terephthalate (PET). Examples of the polishing agent include particles of aluminum oxide, chromium oxide, silicon oxide, diamond, and the like. Alternatively, blasting, chemical polishing, or the like is applicable to smooth the surface of the regulation blade 45, thereby forming the area 45P having the predetermined water contact angle. Yet alternatively, polishing is not necessary if the thin plate is smooth.

Depending on the size of the polished range, processing time becomes longer, and the cost of the wrapping film consumed in the polishing increases. Accordingly, when the area 45P to be polished is limited to an area to which the toner is likely to adhere and the adjacent area, the manufacturing cost and component cost can be reduced.

The regulation blade 45 is secured to the holder 46 by, for example, caulking. Alternatively, welding, press fit, screwing, or the like can be used. A free length of the regulation blade 45 is 11 mm, for example. The free end portion of the thin plate is subjected to bending. With this structure, the amount of toner on the developing roller 41 that has passed the regulation nip N can be restricted. The bend M of the regulation blade 45 is pressed against (or abuts against) the developing roller 41 at a predetermined pressure, thereby forming the regulation nip N between the regulation blade 45 and the developing roller 41. In the present embodiment, the contact pressure between the bend M of the regulation blade 45 and the developing roller 41 is set to 40 N/m. As the developing roller 41 rotates, the toner supplied thereto from the toner supply roller 42 is transported to the regulation nip N. Regulated by the regulation blade 45 in the regulation nip N, the amount of toner is equalized on the surface of the developing roller 41 that has passed the regulation nip N.

If the toner adheres to regulation blade 45 and remains thereon, toner can be melt by heat generated by friction between the regulation blade 45 and the developing roller 41. Then, the toner solidifies and firmly adheres to the regulation blade 45. Further, subsequent toner adheres to the solidified toner, and the adhering toner melts and solidifies thereon. When such adhesion and solidification are repeated and the adhesion of toner grows to a coagulation of about several tens to several hundreds micro meters in size, the coagulation hinders the developing roller 41 from bearing a layer of toner. The coagulation creates a ring-like void (toner absent area) extending along the circumference of the developing roller 41 (in the direction of arc). The void creates a white streak on an image. Although the developing device may further include a cleaner to remove the adhering toner from the regulation blade 45, the developing device can become bulkier when such a cleaner is disposed therein.

Causes of toner adhesion to the surface of the regulation blade are classified in an electrostatic factor and a non-electrostatic factor, and the non-electrostatic factor contributes more to the adhesion. Of various properties of the toner, the softening point of toner relates to the non-electrostatic factor. Currently, to lower the temperature of image fixing for energy saving, development of toner having a low-softening point (hereinafter "low-temperature melting toner) is advancing. Low-temperature melting toner softens easily, and the surface of the softened toner is viscous. Accordingly, the toner easily adheres to an object. To reduce the area of contact with the object, an external additive is added to the surface of a toner base. In one-component development, however, the toner receives stress at each sliding point, and the external additive is peeled off over time. Then, the toner is more likely to adhere to the object.

In developing devices employing low-temperature melting toner, the surface of the regulation blade 45 can be given a property to inhibit adhesion of toner. One parameter indicating the adhesiveness of toner to the regulation blade 45 is a water contact angle of the regulation blade 45 (i.e., a contact angle of the surface of the regulation blade 45 with water). As the water contact angle of an object increases, the surface of the object repels substances more easily. In the present embodiment, as the water contact angle of the regulation blade 45 increases, the surface of the regulation blade 45 better inhibits the toner from adhering thereto.

Low-temperature melting toner having a softening point of from 95 degrees to 120 degrees is preferably used. In one embodiment, low-temperature melting toner having a softening point of 110° C. is used. When the softening point is lower than 95 degrees, prevention of toner adhesion can deteriorate significantly. When the softening point is higher than 120 degrees, the fixing temperature rises, and energy saving becomes difficult. Additionally, in the present embodiment, for example, toner having a volume average particle diameter $D_V$ smaller than or equal to 7 μm is used. When the volume average particle diameter $D_V$ is greater than 7 μm, the fixing temperature rises, and energy saving becomes difficult. Further, attaining a high image resolution becomes difficult.

[Evaluation Experiment]

An experiment was executed to evaluate the occurrence of white streak and image resolution, in relation to the bend angle $\theta_M$ and a water contact angle $\theta_W$ of the bend M. Tables 1-1 and 1-2 present conditions and evaluation results of Examples 1 through 8 according to the present embodiment. Table 2 presents conditions and evaluation results of Comparative examples 1 through 5. The following conditions are common to the present embodiment and the comparative examples.

(Regulation Blade)

The regulation blade 45 was produced using a thin metal plate of Steel Use Stainless, namely, SUS 304 according to Japan Industrial Standard (JIS). The regulation blade 45 was bent at 0.5 mm from the free end. The bend M (extending for 5 mm from the free end of the regulation blade 45) was polished with wrapping film.

(Measurement of Water Contact Angle of Regulation Blade)

As a measuring instrument, an automatic contact angle meter, DM500 (manufactured by Kyowa Interface Science Co., Ltd.) was used.

The measurement conditions are as follows.

The amount of droplets was 2 μl.

Measurement start time after a droplet reached a contact surface was 1000 ms.

As the number of times of measurement, while changing the drop point of the droplet, an identical sample was measured at three points, and a mean value was used as a measurement value.

Drop positions in the longitudinal direction (perpendicular to the surface of the paper on which FIG. 1 is drawn) were positions at 5 cm from each end and a center position. A mean value of the values measured to such three positions was used as the measurement position.

Drop positions in a short side direction were in an area extending for 0 to 3 mm from the downstream end 45E2 of the bend M(R-portion).

The measurement was executed in the following procedure.

Figure 4:
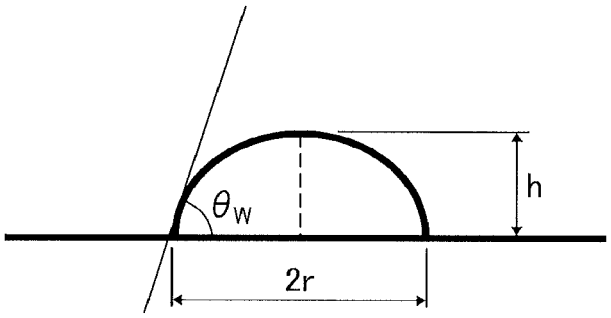
FIG. 4 is a diagram illustrating measurement of a water contact angle.

Set pure water in a syringe, and eject 2 ml of pure water droplets. From the shape of a droplet after 1000 ms from the ejecting, calculate the water contact angle $\theta_W$ using Formula 1 according to a θ/2 method (see FIG. 4).

$$\theta_W = 2\arctan(h/r) \qquad \text{Formula 1}$$

where $\theta_W$ represents the water contact angle, h represents the height of the droplet from the contact surface, and r represents a half width of the droplet on the contact surface.

Toner having a softening point of 110° C. and a volume average particle diameter $D_V$ of 6.5 μm was used.

The toner softening point was measured as follows. Using a flow tester (CFT-500 from Shimadzu Corp.), measure 1.0 gram of the sample. Using a die of 1.0 mm in height and 0.5 mm in diameter, heat the sample at a temperature rising speed of 3.0° C./min (with a preheating time of 120 s) while applying a load of 30 kg and measure the sample in a measurement temperature range of from 40° C. to 140° C. The temperature at which the half of the sample flowed out was used as the softening point.

(Evaluation of Inhibition of White Streak in Images)

A Ricoh color printer, SP C730, was used as a test machine. In the test machine, the regulation blades 45 and the toners according to the examples presented in Tables 1-1 and 1-2 and the comparative examples presented in Table 2 were incorporated in the developing devices 4 and the toner containers 7 of respective colors. As a running test, a full-color chart of 5% page coverage rate (i.e., toner coverage rate in page) was printed on an A4-sheet for each color. While a job of three sheets was repeated, a 2-by-2 halftone chart was printed for each color on every 1000 sheets. An earliest timing at which a vertical white streak occurred on the 2-by-2 halftone image among four colors was recorded.

The running test was continued until the full-color chart having the coverage rate of 5% was printed on 40,000 sheets. The occurrence of white streak was evaluated according to the following criteria. It is preferable to prevent white streaks until 20,000 sheets are printed, and, more preferably, until 40,000 sheets are printed.

Poor: A white streak occurred before the number of printed sheets reached 20,000.

Acceptable: A white streak occurred when the number of printed sheets was greater than 20,000 and smaller than 30,000.

Good: A white streak occurred when the number of printed sheets was greater than 30,000 and smaller than 40,000.

Excellent: No white streak occurred until the number of printed sheets reached 40,000.

(Evaluation of Resolution)

Image resolution was evaluated using a Ricoh color printer, SP C730, as a test machine. In the test machine, the regulation blades 45 and the toners according to each of Configurations 1 through 8 and Comparative examples 1 through 5 were incorporated. Using the test machine and a comparative machine (i.e., SP C730 in which the regulation blades 45 and the toners according to the experiment conditions were not applied), a landscape picture was printed. Then, the images were compared and subjective evaluation was made. Specifically, five valuators compared the image formed by the test machine with the image formed by the comparative machine, and evaluated the resolution subjectively. The rating was "good" when three of the five valuators judged that the image formed by the test machine was equivalent to or better in resolution than the image formed by the comparative machine. The rating was "poor" when three of the five valuators judged that the image formed by the test machine was inferior in resolution to the image formed by the comparative machine.

TABLE 1-1

| Example | | | 1 | 2 | 3 | 4 |
|---|---|---|---|---|---|---|
| Regulation blade | | $\theta_W$[°] | 82 | 82 | 82 | 82 |
| | | $\theta_M$[°] | 20 | 40 | 50 | 90 |
| Toner | | Softening point | 110 | | | |
| | | $D_v$ | 6.5 | | | |
| Evaluation | White streaks | Rating | Excellent | Excellent | Good | Acceptable |
| | | White streak inhibited until | 40,000 sheets | 40,000 sheets | 40,000 sheets | 20,000 sheets |
| | Resolution | Rating | Good | Good | Good | Good |
| | | Number of favorable valuators | 5 | 5 | 5 | 5 |

TABLE 1-2

| Example | | | 5 | 6 | 7 | 8 |
|---|---|---|---|---|---|---|
| Regulation blade | | $\theta_W$[°] | 70 | 70 | 70 | 70 |
| | | $\theta_M$[°] | 20 | 40 | 50 | 90 |
| Toner | | Softening point | 110 | | | |
| | | $D_v$ | 6.5 | | | |
| Evaluation | White streaks | Rating | Good | Good | Acceptable | Acceptable |
| | | White streak inhibited until | 30,000 sheets | 30,000 sheets | 25,000 sheets | 20,000 sheets |
| | Resolution | Rating | Good | Good | Good | Good |
| | | Number of favorable valuators | 5 | 5 | 5 | 5 |

TABLE 2

| Comparative Example | | | 1 | 2 | 3 | 4 | 5 |
|---|---|---|---|---|---|---|---|
| Regulation blade | | $\theta_M$[°] | 69 | 69 | 69 | 69 | 67 |
| | | $0_M$[°] | 20 | 40 | 50 | 90 | 20 |
| Toner | | Softening point | 110 | | | | |
| | | $D_v$ | 6.5 | | | | |
| Evaluation | White streaks | Rating | Acceptable | Poor | Poor | Poor | Poor |
| | | White streak inhibited until | 20,000 sheets | 14,000 sheets | 12,000 sheets | 10,000 sheets | 13,000 sheets |
| | Resolution | Rating | Good | Good | Good | Good | Good |
| | | Number of favorable valuators | 5 | 5 | 5 | 5 | 5 |

As can be known from Tables 1-1 and 1-2, in Examples 1 and 2 of the present embodiment, white streak inhibition is rated as "excellent", and resolution is rated as "good". In Examples 3, 5, and 6 of the present embodiment, white streak inhibition is rated as "good", and resolution is rated as "good". In Examples 4, 7, and 8 of the present embodiment, white streak inhibition is rated as "acceptable", and resolution is rated as "good". It is also known, from Tables 1-1 and 1-2, that when the water contact angle $\theta_W$ is identical, the occurrence of white streaks is inhibited better as the bend angle $\theta_M$ become smaller. In particular, the bend angle $\theta_M$ smaller than or equal to 40 degrees is advantageous in effectively inhibiting the occurrence of white streaks. The resolution was rated as "good" in all of Examples 1 through 8 of the present embodiment.

By contrast, as can be known from Table 2, in Comparative example 1, white streak inhibition is rated as "acceptable", and resolution is rated as "good". In Comparative examples 2, 3, 4, and 5, white streak inhibition is rated as "poor", and resolution is rated as "good".

Figure 5:
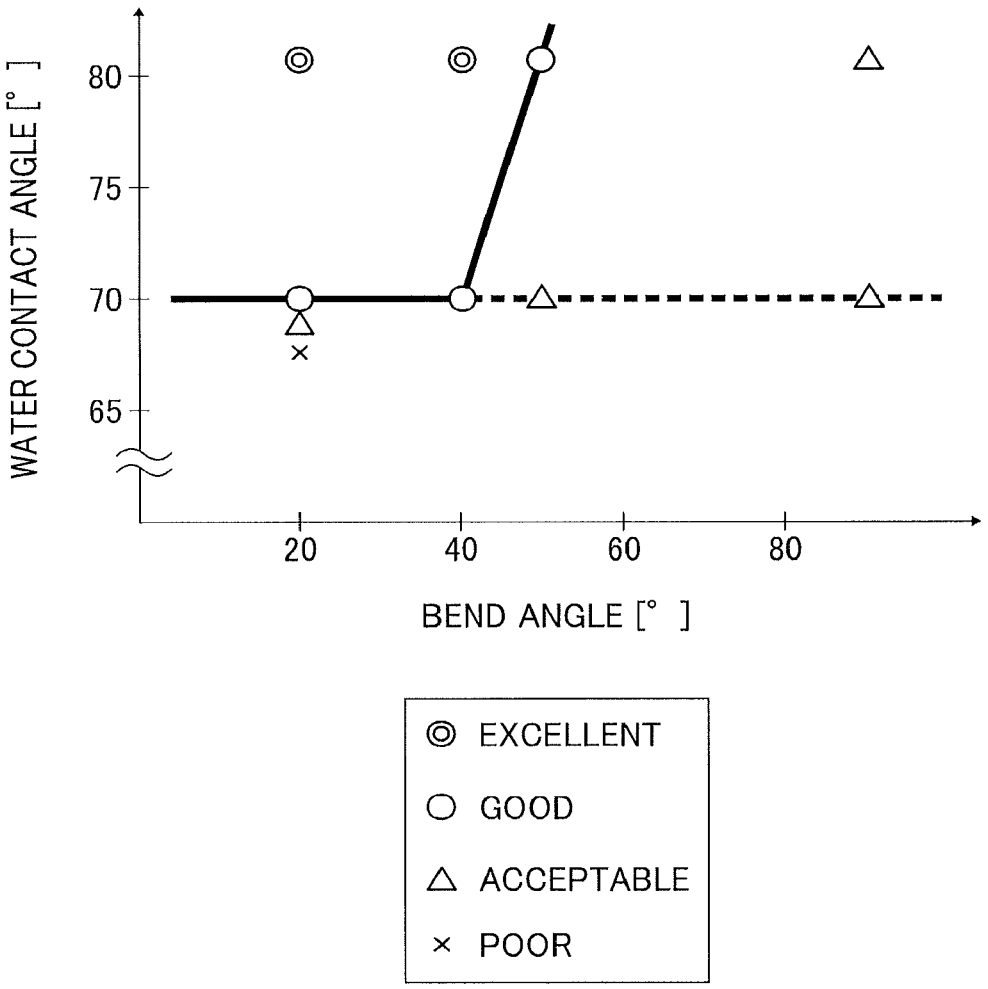
FIG. 5 is a graph illustrating a relation among occurrence of white streaks, a bend angle of a bend (i.e., a curved portion), and a water contact angle based on an experiment.

FIG. 5 is a graph illustrating a relation among occurrence of white streak, the bend angle $\theta_M$ of the bend M, and the water contact angle $\theta_W$ based on the experiment results.

According to the experiment results, when the contact angle of the regulation blade 45 relative to water is greater than or equal to 70 degrees, the surface of the regulation blade 45 inhibits toner from adhering thereto and accordingly suppresses firm adhesion of toner to the regulation blade 45. Accordingly, the occurrence of white streaks is inhibited for a long time, and a cleaner to remove the toner firmly adhering to the regulation blade 45 is not necessary.

Accordingly, the regulation blade 45 according to the present embodiment can inhibit toner adhesion and inhibit the occurrence of white streaks for a long time, while restricting increases in size of the developing device 4.

According to the present embodiment, toner is inhibited from adhering to the regulation blade 45 having the bend angle $\theta_M$ of about 90 degrees. When the bend angle $\theta_M$ is smaller than 90 degrees, toner adhesion is better inhibited. Additionally, when the bend angle $\theta_M$ is smaller than or equal to 40 degrees, the occurrence of white streaks are be inhibited more effectively.

The various aspects of the present specification can attain specific effects as follows.

Aspect A

A developing device (e.g., the developing device 4) includes a toner bearer (e.g., the developing roller 41) to rotate while bearing toner on a surface thereof, and a toner regulator (e.g., the regulation blade 45) including a bend (M) on a free end side thereof. The bend is disposed in contact with the surface of the toner bearer and defines a regulation nip (N) to adjust the amount of the toner on the toner bearer. Additionally, the toner regulator includes an area (e.g., the area 45P) in which a surface has a water contact angle greater than or equal to 70 degrees. The area having the predetermined water contact angle includes, at least, the downstream end (45E2) of the bend in the rotation direction of the toner bearer.

As the contact angle of the surface of the toner regulator relative to water increases, the toner regulator is more likely to repel the toner. That is, the surface has a capability to inhibit toner adhesion. When the surface of, at least, the downstream end of the bend has the capability to inhibit toner adhesion, toner is inhibited from adhering to the toner regulator. Accordingly, a cleaner to remove the toner adhesion to the toner regulator is not necessary, and the developing device can be kept relatively compact.

According to Aspect A, as can be known from the experiment results, in the toner regulator, the water contact angle of the surface of, at least, the downstream end (45E2) of the bend is set to 70 degrees or greater than 70 degrees. Accordingly, while inhibiting the developing device from becoming bulkier, the toner adhesion to the toner regulator is suppressed.

Aspect B

In Aspect A, the toner regulator is shaped like a plate including the bend (M). The bend serves as the nip forming portion. Further, the bend has a bend angle smaller than or equal to 40 degrees. With this configuration, as described above, toner adhesion can be effectively suppressed.

Aspect C

In Aspect A or B, the area in which the water contact angle is 70 degrees or greater extends for a length not greater than 5 mm from the free end of the toner regulator in the rotation direction of the toner bearer. Accordingly, as described above, the manufacturing cost and component cost can be reduced.

Aspect D

In any one of Aspects A through C, the volume average particle diameter of the toner is smaller than or equal to 7 μm. Accordingly, as described above, energy saving and high resolution can be attained.

Aspect E

An image forming apparatus includes an image bearer and the developing device according to any one of Aspects A through C to develop a latent image on the image bearer with the toner. Accordingly, as described above, in the image forming apparatus, toner adhesion to the toner regulator and white streaks in images can be suppressed while keeping the developing device relatively compact.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A developing device comprising:

a toner bearer to rotate while bearing toner; and a toner regulator including a bend on a free end side, the bend disposed in contact with a surface of the toner bearer and defining a regulation nip to adjust an amount of the toner on the toner bearer, the toner regulator including an area having a water contact angle greater than or equal to 70 degrees, the area including, at least, a downstream end of the bend in a rotation direction of the toner bearer, wherein the toner regulator including the bend disposed in contact with the surface of the toner bearer and said area having a water contact angle greater than or equal to 70 degrees are made of a same metal.

2. The developing device according to claim 1, wherein:

the toner regulator is shaped like a plate including the bend, and a bend angle of the bend is smaller than or equal to 40 degrees.

3. The developing device according to claim 1, wherein the area having the water contact angle extends from a free end of the toner regulator for a length not greater than 5 mm in the rotation direction of the toner bearer.

4. The developing device according to claim 1, further comprising a toner containing compartment to contain the toner, wherein a softening point of the toner is in a range of from 95 degrees to 120 degrees.

5. The developing device according to claim 1, further comprising a toner containing compartment to contain the toner, wherein a volume average particle diameter of the toner is smaller than or equal to 7 μm.

6. An image forming apparatus comprising:

an image bearer; and the developing device according to claim 1 to develop a latent image on the image bearer with the toner.

7. The developing device according to claim 1, wherein:

said area is an area of polished metal.

8. The developing device according to claim 1, wherein:

said area having a water contact angle greater than or equal to 70 degrees is limited to the downstream end of the bend in the rotation direction of the toner bearer.

* * * * *